United States Patent [19]

Bagby

[11] 3,972,272

[45] Aug. 3, 1976

[54] MINE BRATTICE

[75] Inventor: James Allen Bagby, Greenville, Ky.

[73] Assignee: Bagby Brattices, Inc., Greenville, Ky.

[22] Filed: Aug. 12, 1975

[21] Appl. No.: 604,003

[52] U.S. Cl. ..... 98/50

[51] Int. Cl.[2] ..... E21F 1/14

[58] Field of Search..... 98/50; 61/45 C, 45 D; 299/12; 160/374, 351; 49/463, 464; 248/354 P

[56] References Cited

UNITED STATES PATENTS

| | | | |
|---|---|---|---|
| 1,478,303 | 12/1923 | Snyder | 98/50 |
| 1,594,921 | 8/1926 | Barnett | 98/50 |
| 1,766,324 | 6/1930 | Berner | 98/50 |
| 1,842,575 | 1/1932 | Allsbury | 160/374 |
| 2,357,819 | 9/1944 | Greer | 160/351 |
| 2,621,725 | 12/1952 | Shacikoski | 98/50 |
| 2,729,064 | 1/1956 | Kennedy et al. | 61/45 |
| 2,729,065 | 1/1956 | Craggs et al. | 98/50 X |
| 3,863,554 | 2/1975 | Boyd | 98/50 |

FOREIGN PATENTS OR APPLICATIONS

| | | | |
|---|---|---|---|
| 64,241 | 11/1955 | France | 98/50 |
| 1,483,887 | 10/1969 | Germany | 61/45 C |

*Primary Examiner*—William F. O'Dea
*Assistant Examiner*—Harold Joyce
*Attorney, Agent, or Firm*—Lane, Aitken, Dunner & Ziems

[57] ABSTRACT

A mine brattice for closing a mine tunnel against the passage of gas including a yieldable framework of lap jointed plate-like beam members having a peripheral configuration corresponding roughly to the peripheral surface configuration of the tunnel to be closed and a sheet metal barrier secured to the framework and extending peripherally beyond the framework into gas sealing engagement with the tunnel surfaces. The barrier is formed of malleable sheet metal such as aluminum by which it may be bent into precise sealing configuration with the rock surfaces of the tunnel. The framework may be supported by anchorage brackets secured directly in the roof, rib and floor surfaces of the tunnel or alternatively on telescopic posts having yieldable shear pin retention means by which telescopic foreshortening of the posts in increments corresponding to spacing of shear pins is permitted to accommodate floor-roof squeeze.

20 Claims, 7 Drawing Figures

MINE BRATTICE

BACKGROUND OF THE INVENTION

This invention relates to mine brattices and more particularly, it concerns improvements in mine brattice structures and in methods for the installation of brattices.

Brattices are commonly used in underground mining as a wall or curtain by which a mine tunnel is sealed against the passage of air or other gases primarily though not exclusively for controlling the flow of air for mine ventillation. In the room and pillar technique commonly employed in the underground mining of coal, for example, brattices are extensively used to seal cross cuts or lateral tunnels to separate air intake and exhaust passages so that ventillating air pumped by fans will be caused to flow from the mine entry to the working faces and back out through the exhaust passages. Brattices are also used to separate working sections of underground mines from previously mined gob areas again to facilitate ventillation of the active or working section but also to prevent the passage of flammable and/or toxic gases from the gob areas to the working section of the mine.

Mine brattices or stoppings are generally classified as permanent or temporary. As these terms imply, temporary brattices are usually in the nature of curtains of canvas, sail cloth or other fabric materials and are employed in the vicinity of the working face of the mine to achieve complete effectiveness of the mine ventillating system, because they are easily and quickly installed and also because they allow passage of men and equipment as needed to facilitate the mining operation. Permanent brattices, on the other hand, are customarily constructed of concrete, cinder blocks or other masonry materials and are accordingly installed rearwardly of the mining operations as the working face is advanced.

While the use of masonry materials is effective to provide a fireproof permanent brattice with adequate wall strength to accommodate the ventillating air pressure differentials which may exist remotely from the mine face to which air must be pumped as well as pressures due to blasting, it will be appreciated that the costs incident to materials, material haulage and labor for installation of masonry brattices are substantial and that the materials cannot be recovered economically for reuse. Moreover, because such brattices do not yield, they are vulnerable to failure as a result of extreme compressive forces brought about by mine roof sagging or floor heaving. Failure under such loading is often manifested by a total collapse of the masonry structure, thereby requiring a substantial reconstruction of the brattice for maintenance of the mine ventillating system.

The problems associated with masonry brattices or stoppings, particularly those resulting from roof or floor squeeze, have been recognized in the prior patent art; for example, U.S. Pat. No. 2,729,064 issued Jan. 3, 1956 to J. R. Kennedy et al and U.S. Pat. No. 3,863,554 issued Feb. 4, 1975 to Newton A. Boyd. In the Kennedy et al patent disclosure, telescopic sheet metal channels extending from the mine floor to the roof are secured in adjacent fashion from transverse supports extending between opposite ribs of the mine tunnel to be closed. Such a structural organization satisfies the requirements of permanent brattices for fireproofing and strength as well as providing a facility for accommodating irregularities in the roof and floor profile. The achievement of a seal along the ribs, however, is difficult because of the linear conformation of the telescopic channel members in contrast to the irregular surface of the ribs. Also the telescopic channel members entail significant fabrication expense. In the Boyd patent, a pliable plastic brattice cloth or laminate is supported on a sealing frame in turn retained against the periphery of the mine tunnel by interconnected extensible jacks having a provision for yielding under conditions of severe roof squeeze. Although brattice cloth may be made to satisfy fireproofing requirements of mine brattices, the strength of such material is less than that required, for example, to withstand pressure differentials developed by blasting. Also, a supporting framework of interdependent jacks or strut-like members is likely to result in a failure in one such member as a result of localized strain deformation of another such member.

Hence it will be appreciated that while mine brattices have evolved to a reasonably refined state of development, there is need for improvement particularly in brattices which fulfill the requirements of permanent stoppings but at lower overall costs to the mine operator than are presently incurred.

SUMMARY OF THE PRESENT INVENTION

In accordance with the present invention, a peripheral framework of longitudinally slotted plate-like beams, lap jointed by bolting for example, is placed about the roof, ribs and floor of the mine tunnel to be closed so as to correspond roughly to the peripheral surface configuration of the tunnel and so that the slots of the struts are presented essentially in a plane transverse to the tunnel. The framework is then covered with a malleable sheet metal barrier, such as aluminum, cut to extend beyond the peripheral framework so that a gas impervious seal with the irregular tunnel surfaces may be made by bending the malleable sheet metal barrier or covering into engagement therewith. The sheet metal may be attached to the framework by bolting through the slotted plate-like beams or by self-tapping screws engageable directly in the slots of the beams.

In one embodiment, the framework is supported by independent jacks or telescopic posts extending between the floor and roof at the location of the brattice. The posts may be jacked into place and retained against telescopic foreshortening by a series of successive shear pins so that the post will yield under compressive roof-floor squeeze forces. In another embodiment, the framework may be secured in place by attachment to angle brackets in turn secured by expansion bolts located within bores drilled directly in the floor, roof and ribs of the tunnel to be secured. In both of these embodiments, the framework may include, in addition to the beams approximating the peripheral contour of the tunnel, one or more cross beams each of which is formed by two or more of the slotted plate-like beams so as to be yieldable under the compressive loading as a result of roof or floor squeeze.

Among the objects of the present invention are: the provision of an improved mine brattice and method for its installation; the provision of such a mine brattice which provides for permanent stoppage of gas flow in a mine tunnel irrespective of roof and floor shifting; the provision of a mine brattice structure which meets the requirements of a permanent mine brattice installation and from which the component parts are substantially recoverable for reuse; the provision of such a mine brattice structure which is yieldable to accommodate roof sagging movement or floor heaving movement in a manner to provide a visual and audible indication of such movement; the provision of a mine brattice in which a reduction in floor to roof height as a result of roof sag or floor heave improves the peripheral seal between the brattice and the mine tunnel in which it is located; the provision of a mine brattice which is easily installed and easily repaired if damaged; and the provision of an unique method for installing mine brattices.

Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENTS

Figure 1:
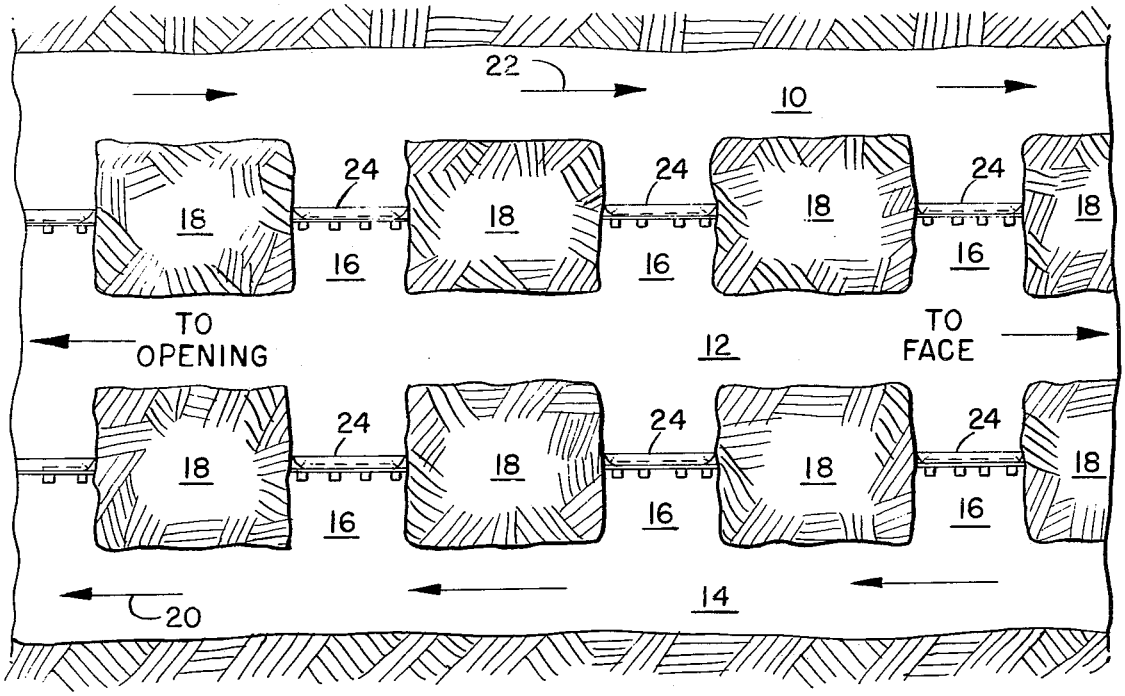
FIG. 1 is a fragmentary plan view of a conventional mine section incorporating the improved brattice structure of the present invention.

In FIG. 1 of the drawings, a typical multiple-entry coal mine section is shown to include three longitudinal entry tunnels 10, 12 and 14 interconnected by longitudinally spaced cross-cut tunnels 16 to establish pillars 18. The illustrated section depicts the tunneling which remains after a mining operation has proceeded from the mine opening to a working face or from left to right in FIG. 1. The pillars 18 are left to minimize the span of unsupported roof in the entries 10, 12 and 14 which establish respectively, air intake, haulage and air return courses extending from the mine opening to the working face. The cross-cut tunnels 16 are made to maximize the tonnage of coal which may be removed from the mine section and also to facilitate movement of men and equipment at the working face.

Ventillating air is pumped from the mine opening to the working face by fans (not shown) located in the return course established by the entry tunnel 14 and operative to move air through the return course in the direction of the arrows 20. Intake air is thus passed through the air intake tunnel 10 in the direction of the arrows 22 and circulated past the working face. It will be appreciated that the supply of ventillating air to the working face in this manner necessitates a sealing off or closing of the cross-cut tunnels 16 throughout the length of the entry tunnels 10 and 14 to prevent shunting of intake air to the air return course 14 at a point rearwardly short of the working face. To this end, stoppings or brattices 24 must be installed in each of the cross-cut tunnels 16 to close the tunnels against the passage of gas. As previously mentioned, the closure of the cross-cuts 16 against the passage of gas in the vicinity of the face is typically by temporary or curtain-like cloth brattices which are replaced by permanent brattices as the mine operation proceeds. Such permanent brattices are also used to seal off entry and cross-cut tunnels in sections of the mine which are no longer needed for transportation of men and equipment or for haulage of coal from the working face to the mine opening.

Figure 2:
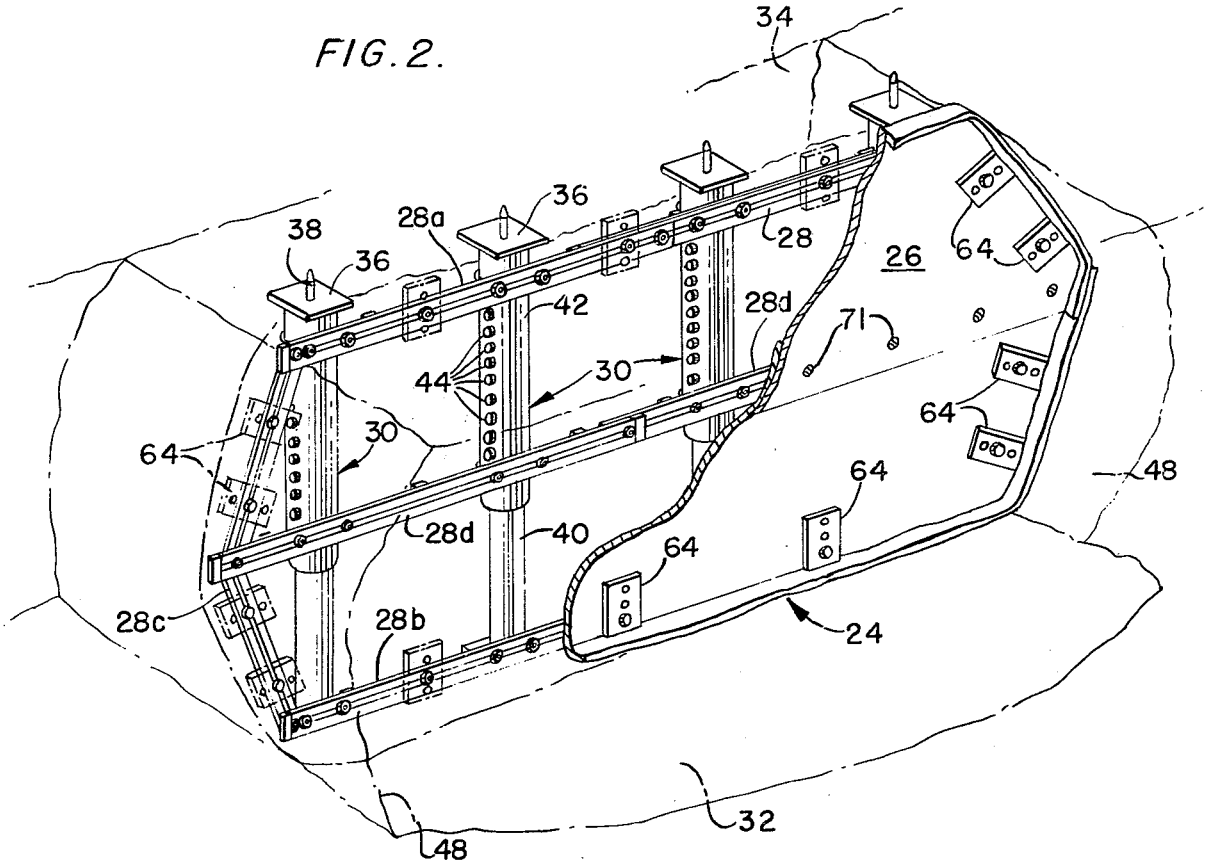
FIG. 2 is a perspective view, partially cut-away and illustrating a preferred embodiment of the present invention.
Figure 3:
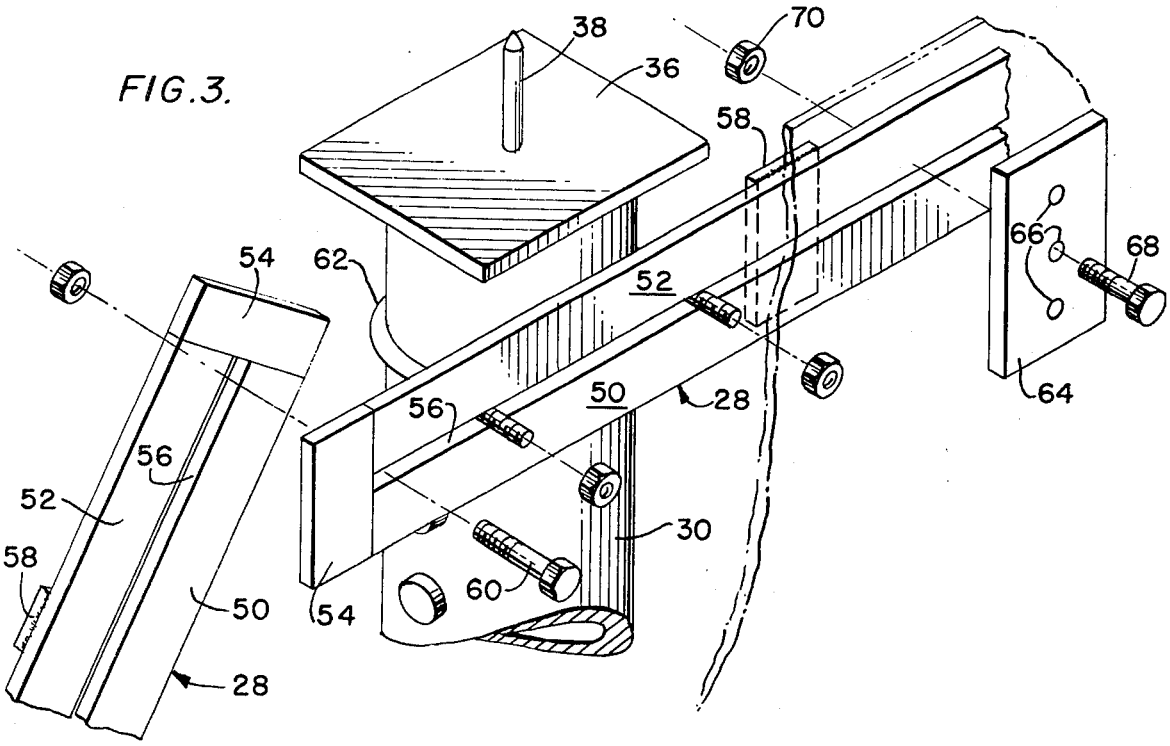
FIG. 3 is an enlarged fragmentary exploded perspective view illustrating components of the present invention.
Figure 4:
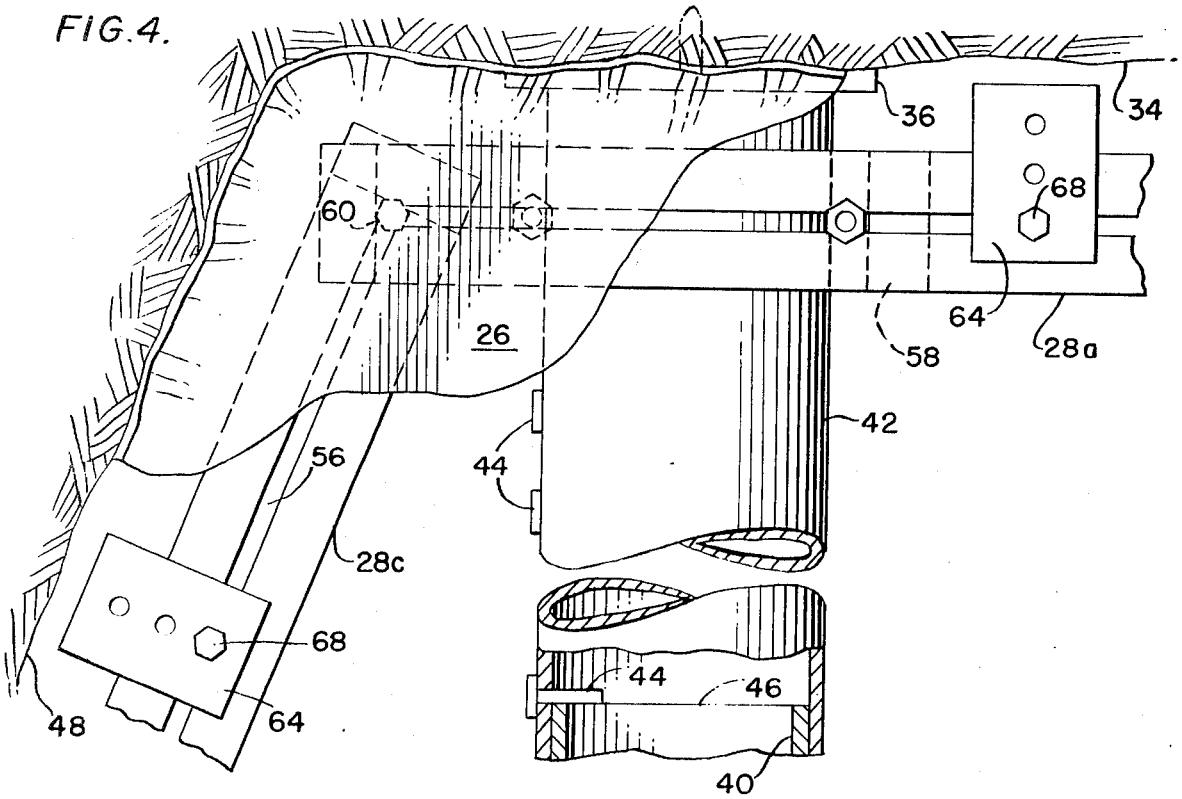
FIG. 4 is an enlarged fragmentary front elevation in partial cross-section of the embodiment illustrated in FIG. 2.

The present invention is directed to the structure and installation of the permanent brattices or stoppings 24, one embodiment of which is depicted by FIGS. 2–4 of the drawings. As shown in these figures, a sheet metal barrier 26 is supported by a framework of slotted plate-like beams 28 mounted on a plurality of laterally spaced and thus independent anchorage posts 30 extending from the floor 32 to the roof 34 of the tunnel to be closed against passage of air and other gases. Each of the posts 30 is provided on opposite ends with bearing plates 36 from which anchorage dowels 38 project to assure firm engagement with the floor and roof of the tunnel in which the posts are set. As shown most clearly in FIGS. 2 and 4, the posts 30 are formed by inner and outer telescopic sections 40 and 42 respectively. In practice, the outer section 42 may be formed, for example, of a three inch double strength steel pipe and the inner section 40 of one and a half inch double strength pipe which approximates in outside diameter the three inch inside diameter of the outer section 42. It is contemplated, however, that other specific materials and configuration of materials may be used to establish the telescopic posts 30.

The outer section 42 of each post 30 is provided along its length with a series of apertures through which shear pins 44 are inserted to restrain telescopic foreshortening of the posts in increments corresponding to the vertical spacing of the shear pins 44, which may be approximately two inches, for example, and under compressive forces corresponding to the shear strength of the individual pins 44. It will be appreciated, therefore, that the posts 30 may be installed by jacking the telescopic sections 40 and 42 into firm engagement with the floor 32 and 34 until the dowels 38 are firmly embedded and then inserting the shear pins 44 throughout the length of the outer section 42 extending beyond the upper end 46 of the lower section 40. The placement jacks are then removed so that the upper end 46 of the lower section bears against the lowermost shear pin 44 in the outer section 42. As a result of this construction, roof-floor squeeze forces exceeding the shear strength of one of the shear pins 44, such as for example, 2,000 pounds, will result in a breakage of the lowermost shear pin and foreshortening of the posts 30 until the upper edge 46 of the inner section 40 engages the next successive shear pin. The breakage of each shear pin will, of course, be accompanied by an audibly detectable sound and further, the foreshortening can be observed visually by inspection of the pins.

As shown most clearly in FIGS. 2 and 3 of the drawings, the plate-like beams 28 establishing the framework on which the sheet metal barrier 26 is supported are similar in structure and vary only in length depending on the position occupied in the framework. In particular, the beams 28*a* and 28*b* which generally parallel the roof and floor between the ribs 48 of the tunnel to be closed are relatively long (on the order of 10 feet) whereas the beams 28*c* extending about the ribs 48 are shorter (on the order of 3 feet) in order that the peripheral configuration of the framework may complement roughly the cross-sectional configuration of the tunnel in which the brattice is installed. Also each of the beams 28 in the disclosed embodiment is formed of steel bar stock 3/16 inch thick and 1 inch wide, two such bars 52 extending the length of each beam and secured at opposite ends in spaced relation by welded headers 54 to establish a slot 56, preferably on the order of ¼ inch in width and extending the length of each beam. Reinforcement blocks 58 may be welded at spaced increments along the length of each beam to assure dimensional uniformity and stability of the slot 56. Although this construction of the beams 28 has been found desirable in practice and is therefore preferred, it is contemplated that other materials, such as aluminum, may be used as well as other sizes and slotted configurations.

As shown most clearly in FIG. 3, the beams 28 are secured to each other at opposite ends by single bolts 60 extending through the respective slots 56 of the beams to be joined thus to establish a pivotal lap joint connection of the respective beams 28. U-bolts 62 may be used for attachment of the framework of the beams 28 to the posts 30. Though other forms of attachment to the posts may be used, such as self-tapping screws, the illustrated U-bolts are preferred inasmuch as they provide for a measure of relative sliding of the framework on the posts.

As shown in FIG. 2, the beams 28*a*, 28*b* and 28*c* are assembled to each other and to the posts 30 to establish a continuous peripheral framework of closed polygonal configuration corresponding roughly to the cross-section of the tunnel and so that the slots 56 in the beams are transverse to the plane of the brattice. In addition to the peripherally disposed beams, intermediate cross-beams 28*d* may extend across the width of the tunnel as shown in FIG. 2. In order to accommodate dimensional changes in the tunnel as a result of roof sagging or floor heaving commonly experienced in coal mines, it is important that at least two individual beams 28 be used on any line extending diametrically across the tunnel in order that dimensional changes may be accommodated by pivotal movement or slippage at the lap joint of the beams to each other. In this way the distortion of the framework will not result in any damage to the individual beams 28, a feature which is important from the standpoint of reuse of the beams after the brattice in which they are incorporated is no longer needed. Moreover, the peripheral disposition of the beams 28*a*, 28*b* and 28*c* coupled with the cross-beams 28*d* effects a resolution of roof-floor squeeze forces into an overall tightening of the framework in the tunnel. Hence the peripheral seal between the barrier and the tunnel improves with time and as a result of roof sag or floor heaving.

Figure 7:
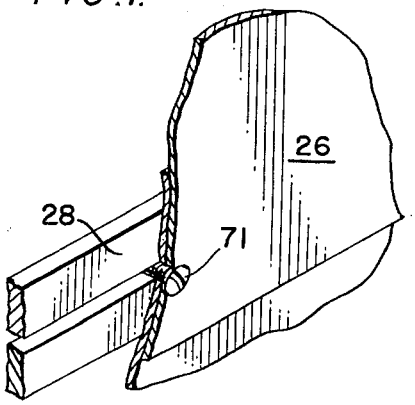
FIG. 7 is a fragmentary perspective view illustrating the attachment of the barrier sheet of the present invention to a frame component.

The manner in which the sheet metal barrier 26 is installed and supported from the framework of plate-like beams 28 may be understood by reference particularly to FIGS. 2 and 4 of the drawings. The sheet metal, which may be supplied in strip form on rolls, is cut to the approximate cross-sectional configuration of the tunnel but oversized for reasons which will be more apparent from the description to follow below. The trimmed sheet metal is placed directly against the framework of beams 28 and secured at least to the peripheral framework beams 28*a*, 28*b* and 28*c*, by mounting plates 64 bolted through the barrier sheet 26 and the slots 56 of the respective beams 28. Each of the mounting plates is provided with a plurality of bolt holes 66 so that a bolt 68 used for mounting the plate may be inserted through the appropriate hole 66 to position the extreme outer edge of each plate beyond the respective beams 28 as needed for placement of this plate edge in close proximity to the rock surfaces of the tunnel floor, roof and ribs. As a result, the barrier sheet will be drawn tightly into sealing engagement with the transverse perimeter of the tunnel. Although the bolt 68 employed to secure the plate 64 and barrier sheet against the beams 28 is illustrated as a machine bolt having a nut 70, it is contemplated that the bolt 68 may be a self-tapping screw having an effective diameter larger than the width of the slot 56 in the beams 28 so that the plate may be drawn tightly against the beams by engagement of the self-tapping screw threads in the slot 56. In addition, the barrier sheet may be secured at intermediate points in this manner by self-tapping screws 71 as illustrated in FIGS. 2 and 7 of the drawings. Further as shown in these latter figures, it is preferred that the barrier sheet be cut from sheet material of a width such that at least two sheets extend across the brattice and overlap vertically at the intermediate cross-beams 28*d*.

An important feature of the present invention is that the barrier 26 be formed of a malleable sheet material which may be bent by hand into sealing engagement with the rock surfaces of the tunnel floor, ribs and roof. Aluminum sheet having a gauge or thickness of 0.017 inches has been found to provide extremely satisfactory results in this respect. Such material may be easily cut to a shape roughly corresponding to the peripheral configuration of the tunnel in which the brattice is to be installed and may be worked essentially by hand into precise sealing engagement with the rock surfaces of the tunnel as illustrated, for example in FIG. 4 of the drawings. Other similar materials such as copper or malleable grades of sheet steel may be used. Obviously, a less ductile material such as sheet steel would be more difficult to bend by hand though peripheral working of such materials may be achieved by the use of a larger number of the mounting plates 64 since the compressive or sheet bending forces which may be applied to the sheet material by bolting the plates 64 against the material about the periphery thereof may be adequate to achieve the desired seal. Moreover, the peripheral seal may be augmented by hammering such materials into engagement with the rock surfaces of the tunnel. Also it will be appreciated that the essentially continuous facility for mounting the sheet metal barrier 26 to the frame as a result of the longitudinal slots 56 in each of the beams 28 will enable an air-tight barrier to be established by a plurality of sectional or relatively small sheets. By using a larger number of individual sheets to form the barrier 26, the problems associated with precutting the barrier sheet to the approximate conformation of the tunnel are reduced. The use of sheet steel and other such materials which are less malleable than aluminum, for example, may be facilitated in this way inasmuch as the precise conformation of the tunnel may be more easily assimilated with a large number of relatively small sheets. Also patching of the barrier sheet is possible using self-tapping screws extending through the beam slots 56.

Figure 6:
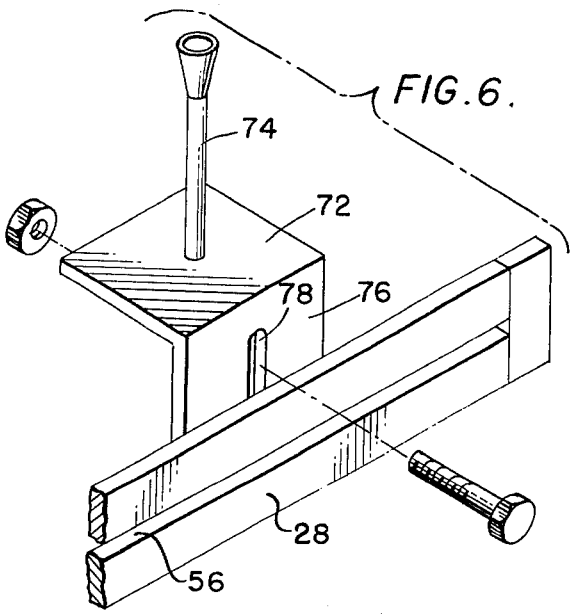
FIG. 6 is an enlarged fragmentary and exploded perspective view illustrating the mounting bracket components of the embodiment of FIG. 5.
Figure 5:
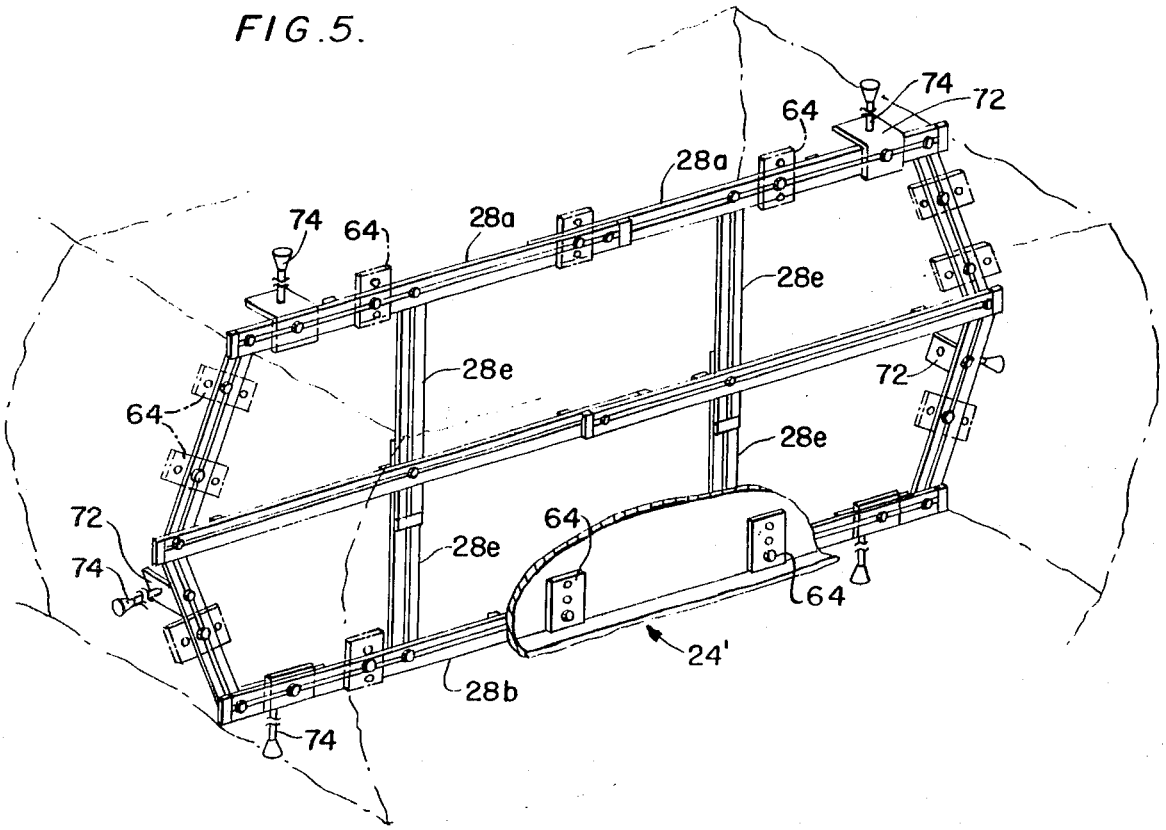
FIG. 5 is a perspective view similar to FIG. 2 but illustrating an alternative embodiment of the present invention.

In the alternative embodiment illustrated in FIGS. 5 and 6 of the drawings, the framework of slotted plate-like beams 28 and the barrier 26 is again employed in the same manner as the embodiment previously described. In this instance, however, the telescopic posts 30 are omitted and the framework of beams 28 anchored in place by angle brackets 72 secured in the roof, floor and ribs of the tunnel by self-anchoring bolts 74 constructed and installed in the manner of roof bolts commonly used in mines for roof support. The angle brackets are shown in FIG. 6 to include a right angle flange 76 having a bolting slot 78 so that the beams 28 can be secured to the bracket 72 by bolts 80 extending through the beam slot 56 and the slot 78. Also vertical cross-beams 28*e* may extend between the upper beams 28*a*, the intermediate or transverse beams 28*b*, and the lower beam 28*b* as shown in FIG. 5. Because of the lap joint connection of the beams 28*e*, any change in the vertical dimension of the tunnel as a result of roof-floor squeeze will be accommodated by slippage of the beams with respect to the bolt securing the respective lap joints.

The embodiment of FIGS. 5 and 6 is particularly suited to the use of a large number of relatively small sheets to form the barrier 26 because any number of lap joints in the barrier as shown in FIG. 7 may be accommodated simply by adding a corresponding number of intermediate cross-beams 28d and 28e. Also the beams may be assembled to provide frames for doors or other portals in the constructed brattice.

Thus it will be appreciated that by this invention there is provided an unique brattice structure and method by which the above-mentioned objectives are completely fulfilled. Also it will be apparent to those skilled in the art that various modifications and/or changes can be made in the disclosed embodiment without departure from the present invention. It is expressly intended, therefore, that the foregoing is illustrative of preferred embodiments only, not limiting, and that the true spirit and scope of the present invention be determined by reference to the appended claims.

I claim:

1. A mine brattice comprising:

a plurality of beam members to provide a continuous peripheral framework of closed polygonal configuration corresponding roughly to the transverse configuration of a mine tunnel opening to be closed against the passage of gas;

a gas impervious barrier of malleable sheet metal secured to and covering said framework, said sheet metal projecting outwardly beyond said framework and being deformed as necessary by bending to complement and engage the peripheral surfaces of the mine tunnel; and means yieldably interconnecting said beam members to accommodate pivotal and slidable movement of each beam member relative to the other in planes parallel to said barrier, thereby to render said framework yieldable to accommodate dimensional changes in the transverse configuration of the mine tunnel.

2. The apparatus recited in claim 1 including angle brackets anchored in the mine tunnel for supporting said framework.

3. The apparatus recited in claim 1 wherein said malleable sheet metal is aluminum.

4. A mine brattice comprising:

means to provide a yieldable continuous peripheral framework corresponding roughly to the transverse configuration of a mine tunnel opening to be closed against the passage of gas, said peripheral framework being formed by a plurality of plate-like beams having longitudinal slots therein;

a gas impervious barrier of malleable sheet metal secured to and covering said framework, said sheet metal projecting outwardly beyond said framework and being deformed as necessary by bending to complement and engage the peripheral surfaces of the mine tunnel, said beams being oriented so that said slots open transversely to said barrier; and means yieldably interconnecting said beams to accommodate pivotal and slidable movement of each beam relative to the other in planes parallel to said barrier.

5. The apparatus recited in claim 4 wherein said beam interconnecting means comprises a single bolt extending through said slots near overlapping ends of two such beams.

6. A mine brattice comprising:

means to provide a yieldable continuous peripheral framework corresponding roughly to the transverse configuration of a mine tunnel opening to be closed against the passage of gas;

a plurality of transversely spaced vertical anchorage posts for supporting said framework, said posts including first and second relatively slidable sections and a plurality of vertically spaced shear pins for incrementally restraining said sections against foreshortening relative movement; and a gas impervious barrier of malleable sheet metal secured to and covering said framework, said sheet metal projecting outwardly beyond said framework and being deformed as necessary by bending to complement and engage the peripheral surfaces of the mine tunnel.

7. A mine brattice comprising:

a framework of slotted plate-like beams lap jointed to each other to accommodate relative pivotal and slidable yielding movement of said beams in a plane transverse to a mine tunnel to be closed, said framework having a closed polygonal peripheral configuration corresponding roughly to the transverse surface configuration of the mine tunnel;

anchorage means for supporting said framework; and a gas impervious barrier sheet secured to said framework and extending peripherally into sealing engagement with the roof, rib and floor surfaces of the tunnel.

8. The apparatus recited in claim 7 wherein said beams comprise a pair of bars butt welded at opposite ends to headers, said bars being spaced to provide a slot extending the length of each beam between said headers.

9. The apparatus recited in claim 8 including plate weldments spanning said bars and said slots and spaced along the length of each beam to assure dimensional uniformity and stability of said slots.

10. The apparatus recited in claim 8 wherein said bars are formed of steel on the order of 3/16 inch in thickness and one inch in width, the spacing of said bars to provide said slot being on the order of ¼ inch.

11. The apparatus recited in claim 7 wherein said anchorage means for supporting said framework comprises a plurality of transversely spaced vertical anchorage posts, each of said posts including inner and outer telescopic sections and including yieldable means for resisting telescopic foreshortening of said sections.

12. The apparatus recited in claim 11 wherein said yieldable means comprises a plurality of vertically spaced shear pins mounted in said outer telescopic section, said shear pins being successively engaged by said inner telescopic section upon relative foreshortening movement of said sections due to loading of said posts by forces in excess of the shear strength of said shear pins.

13. The apparatus recited in claim 12 including U-bolts extending about said anchorage posts and through said slotted beams for securing said framework to said anchorage posts.

14. The apparatus recited in claim 7 wherein said anchorage means comprises a plurality of angle brackets secured in the roof, rib and floor surfaces of the tunnel to be closed said brackets having a flange extending transversely of the tunnel.

15. The apparatus recited in claim 14 wherein said flanges include a bolting slot for connection of said framework thereto.

16. The apparatus recited in claim 10 wherein said gas impervious barrier sheet is formed of malleable sheet metal capable of hand worked into sealing engagement with the peripheral surfaces of the tunnel.

17. The apparatus recited in claim 1 including mounting plates overlying said barrier sheet and bolted through said slotted beams, said mounting plates extending outwardly of said beams into close proximity with the tunnel walls.

18. The method for installing mine brattices comprising the steps of:

setting a plurality of anchorage members essentially in a plane extending transversely of a mine tunnel to be closed;

mounting a peripheral framework of slotted beam members to said anchorage members, said beam members being lap jointed to each other for relative pivotal and slidable yielding movement parallel to said plane;

attaching a malleable sheet metal barrier to said framework so that the edges of said barrier project peripherally beyond said framework; and bending the projecting peripheral edges of said barrier into sealing engagement with the tunnel surfaces.

19. The method recited in claim 18 including mounting cross-beams to said peripheral framework and attaching said sheet metal barrier in sections overlapping on said cross-beams.

20. The method recited in claim 18 comprising the step of drawing mounting plates against said barrier sheets and said framework to bend the projecting peripheral edges of said barrier into sealing engagement with the tunnel surfaces.

* * * * *